United States Patent [19]

Stieber et al.

[11] Patent Number: 4,767,930

[45] Date of Patent: Aug. 30, 1988

[54] METHOD AND APPARATUS FOR ENLARGING A CHARGED PARTICLE BEAM

[75] Inventors: Volker Stieber; Franz Krispel, both of Walnut Creek, Calif.

[73] Assignee: Siemens Medical Laboratories, Inc., Walnut Creek, Calif.

[21] Appl. No.: 33,133

[22] Filed: Mar. 31, 1987

[51] Int. Cl.[4] ..... G21K 1/08

[52] U.S. Cl. ..... 250/396 ML; 250/396 R; 250/398; 250/492.3

[58] Field of Search ..... 250/396 R, 396 ML, 398, 250/492.3

[56] References Cited

U.S. PATENT DOCUMENTS

| | | | |
|---|---|---|---|
| 2,866,902 | 12/1958 | Nygard | 250/396 |
| 3,028,491 | 4/1962 | Schleich | 250/396 |
| 3,120,609 | 2/1964 | Farrell | 250/396 |
| 4,293,772 | 10/1981 | Stieber | 250/492.2 |

FOREIGN PATENT DOCUMENTS

| | | | |
|---|---|---|---|
| 398347 | 5/1964 | Japan | 250/398 |

OTHER PUBLICATIONS

Electromedica No. 3–4, 1977, "Radiotherapy Today: The Mevatron 20, a Compact High-output Linear Accelerator", Haas et al., pp. 101 to 106.

Medical Physics 11, 1984, "Advances in Linear Accelerator Design for Radiotherapy", Karzmark, pp. 105 to 127.

*Primary Examiner*—Carolyn E. Fields
*Assistant Examiner*—John A. Miller
*Attorney, Agent, or Firm*—Mark H. Jay

[57] ABSTRACT

A method and an apparatus for irradiating a relatively large area with a charged particle beam. In the method, a pencil-like beam is generated and spread along a fan axis perpendicular to the beam axis. The fan axis is rotated around the beam axis so that finally a circular area is irradiated. The apparatus includes means for generating a pencil-like beam, a lens system for spreading the beam along the fan axis and means to rotate the fan axis around the beam axis. In a preferred embodiment, the beam is spread such that its transverse intensity distribution increases with increasing distance from the beam center so that the area swept by the beam is irradiated with an even intensity.

13 Claims, 4 Drawing Sheets

METHOD AND APPARATUS FOR ENLARGING A CHARGED PARTICLE BEAM

BACKGROUND OF THE INVENTION

The invention relates to the irradiation of matter with a charged particle beam. In particular, it relates to a method and an apparatus for manipulating an electron beam of small cross section so that it can cover a relatively large area.

Various techniques have been developed to diffuse an electron beam (which usually has a diameter of about one millimeter) to irradiate areas having diameters exceeding 20 centimeters.

In Electromedica No. 3-4 (1977) pages 101 to 106, there is disclosed a linear electron accelerator (LINAC) in which a set of consecutive scattering foils creates an enlarged circular cross section with a homogeneous intensity distribution. The foils have a number of disadvantages: the average beam energy is decreased; the energy spectrum is widened; the energy level and/or the field size cannot be changed easily; and undesirable X-ray radiation is produced in both foils.

One way to prevent X-rays is to spread or scan the pencil-like beam along a fan axis perpendicular to the beam axis, i.e. by a magnetic or electrostatic lens, and to move the matter to be irradiated across the fan axis. This technique, which is described in more detail in U.S. Pat. No. 2,866,902, is used for sterilizing and preserving food, but has not yet been used for radiotherapy of humans. This is because it is not easy to ensure that a predetermined area of a laterally moved body is irradiated with an even intensity distribution.

The patient can be kept in a stationary position if the beam is transversely enlarged along both main axes. This is achieved, as disclosed in U.S. Pat. No. 3,120,609, by sending the beam through a quadrupole magnet. The magnet is designed so that the beam is defocused along one axis and along the other axis first focused and then, after the cross over of the beam particles, fanned out. Such an approach makes it difficult to obtain a homogeneous intensity distribution and, in particular, an accurate field limitation.

In Medical Physics 11 (1984) pages 105 to 127, section "Scanned Pencil Beams", there is mentioned a further alternative in which the electron beam passes two scanning magnets placed orthogonal to each other. By varying their magnetic fields, a raster or spiral scan can be provided. This scan technique is capable of providing treatment fields which are uniform and arbitrarily variable. Disadvantageous is however, that the beam needs a relatively long time to sweep the whole area and requires complex control and monitoring circuits to avoid "hot spots".

It is an object of this invention to provide a method and means for distributing the intensity of a charged particle beam over a relatively large area such that this area is irradiated with a substantially uniform current intensity.

It is another object of this invention to provide a method and means for distributing a charged particle beam so that the initial energy spectrum of the beam particles is not significantly altered.

It is a further object of the invention to provide a method and means for distributing a charged particle beam without creating detrimental X-rays.

It is yet another object of this invention to provide a method and means for distributing a charged particle beam so that the area to be irradiated and/or the energy level of the charged particle beam can be varied.

It is still another object of this invention to provide a method and means for distributing a charged particle beam in a mechanically and electrically simple manner.

It is a further object of this invention to provide a method and means for distributing a charged particle beam over a relatively large area so that the whole area is covered within a short time.

Still another object of this invention is to improve on the existing methods and means to enlarge charged particle beams.

SUMMARY OF THE INVENTION

In one form of the invention, there is provided a method for irradiating a relatively large area with a charged particle beam. This method comprises the following steps: a pencil-like beam having a relatively small cross section is generated and emitted along a beam axis. This beam is then spread along a fan axis which is perpendicular to, and rotates around, the beam axis. This way the beam eventually covers a circular area.

According to a more specific aspect of the present invention, the pencil beam is spread so that it becomes more intensive with increasing distance from the beam axis.

In another form of this invention, there is provided an apparatus for irradiating a relatively large area with a charged particle beam. This apparatus has a source for generating a pencil-like charged particle beam and a guiding system for emitting this beam along the beam axis. There is furthermore provided a lens system for spreading the emitted beam along a fan axis perpendicular to the beam axis. In addition, the apparatus has a means for moving the fan axis around the beam axis so that the beam sweeps a circular area.

According to a more specific aspect, the lens system comprises a set of n divergent lenses, each tending to spread the beam along a specific fan axis. The fan axes lie in a plane perpendicular to the beam axis, intersecting each other in the beam axis, with an angle of 360°/n between adjacent fan axes. The spreading power of the individual lenses is varied according to a periodic function, with a phase shift of 360°/n between consecutive lenses. Advantageously, the number of lenses is three.

In a preferred embodiment, the lens system is non-linear in the sense that it deflects charged particles which are close to the beam center, to a higher degree than charged particles more remote from the center.

The foregoing and other objects, features and advantages of the invention will be apparent from the following more particular description of preferred embodiments of the invention, as illustrated in the accompanying drawings.

DETAILED DESCRIPTION OF PREFERRED EMBODIMENTS

For the sake of clarity, the embodiments, which contain only parts essentially known per se, are depicted in a simplified manner. Throughout the drawings, like elements are designated with the same numerals.

Figure 1:
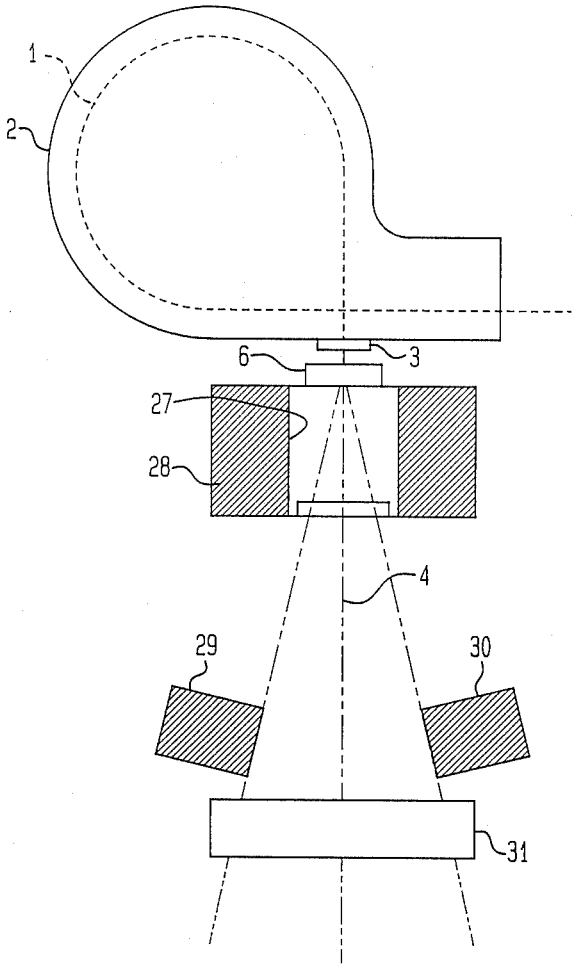
FIG. 1 is a cross section of the beam defining part of a LINAC, containing a first embodiment of the invention.

FIG. 1 shows from a LINAC a bending magnet 1 which sends an electron beam 2 through a window 3 along a beam axis 4. The beam has a diameter of about 1 millimeter and comprises electrons of about 10 MeV. The current intensity across the beam is highest at its center and decreases gradually towards its periphery. After leaving window 3, beam 2 passes a beam diffusing lens system 5, a passage way 27 of a shielding block 28, and a beam defining jaw system with two pairs of opposite jaws 29, 30, 31.

Figure 2:
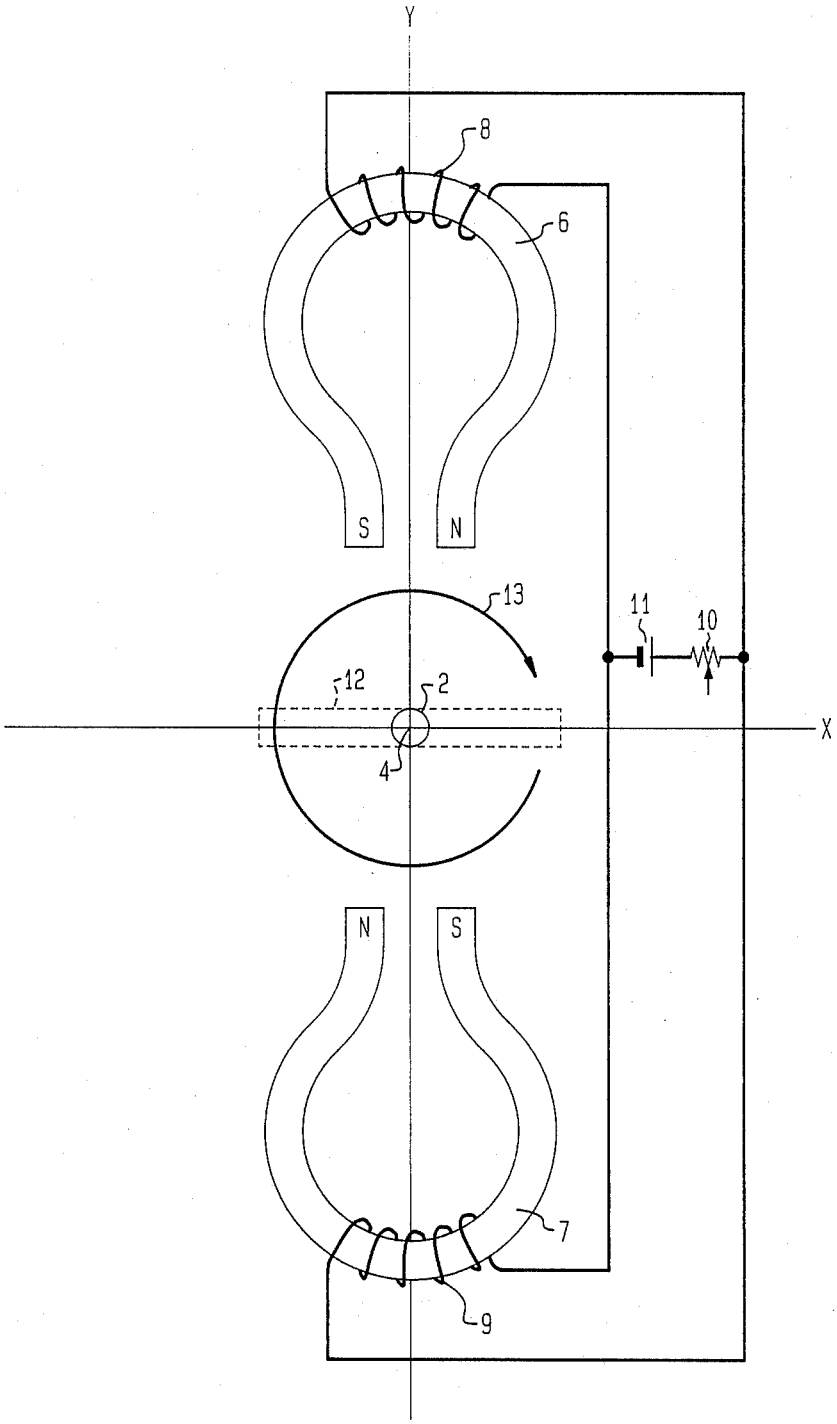
FIG. 2 is a cross section along line II—II of the embodiment shown in FIG. 1.

Lens system 5 contains, as depioted in FIG. 2, a quadrupole magnet consisting of two horseshoe magnets 6, 7. The two horseshoe magnets are wrapped with coils 8 and 9, respectively, which are jointly connected—via a variable resistor 10—to a current supply 11. Both magnets 6, 7 are disposed in a X-Y plane perpendicular to the beam axis, with their poles arranged such that the north pole of one magnet is placed opposite the south pole of the other one. The magnetic field is zero at the beam axis 4, directed downward to the right of the beam axis and directed upward to the left of the beam axis so that all the electrons which are not on the Y-axis are deflected away from the beam axis. The result is a flattened beam as shown by a broken line 12. The distance between adjacent poles along the X-axis is small compared with the distance between opposite Poles along the Y-axis so that the magnetic field has actually no components along the X-axis. Therefore, the beam is neither focused nor defocused along the Y-axis.

By adjusting the value of resistor 10 the current through the coils and thus the strength of the beam spreading magnetic fields may be varied.

The beam emitted through window 3 is most intense at the beam axis 4; the intensity drops according to a Gaussian distribution toward the beam edge. This distribution should be changed by the lens system so that the fanned beam becomes more intensive with increasing distance from the beam axis 4. Only then can the circular area swept by rotating the fan axis around the beam axis 4, receive a uniform intensity without additional means. In order to reverse the original intensity distribution, the Y-component of the magnetic field must be attenuated with increasing distance X. The exact function is obtained by properly shaping and arranging the four magnetic poles.

The lens system can be rotated around the beam axis 4, as indicated by an arrow 13. With this mechanical rotation, the fan axis revolves around the beam, so that after a half cycle, the fanned beam has covered the circular area.

Figure 3:
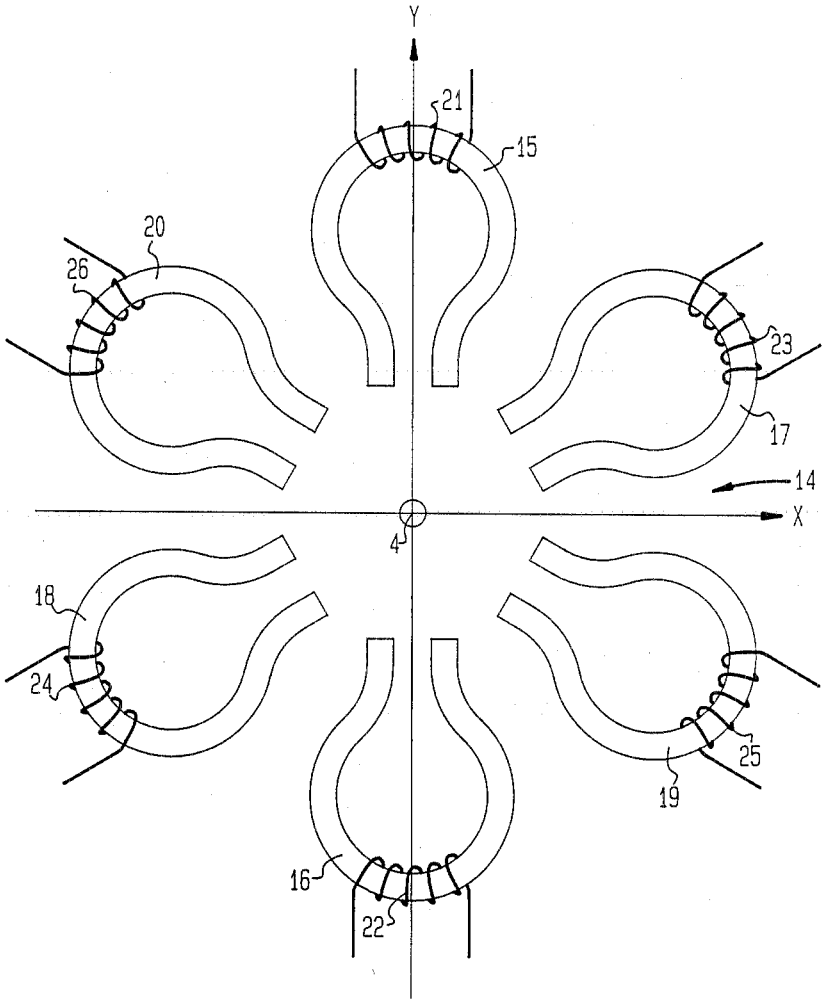
FIG. 3 shows from another embodiment of the invention the lens system and the means for rotating the fan axis, seen along the beam axis.
Figure 4:
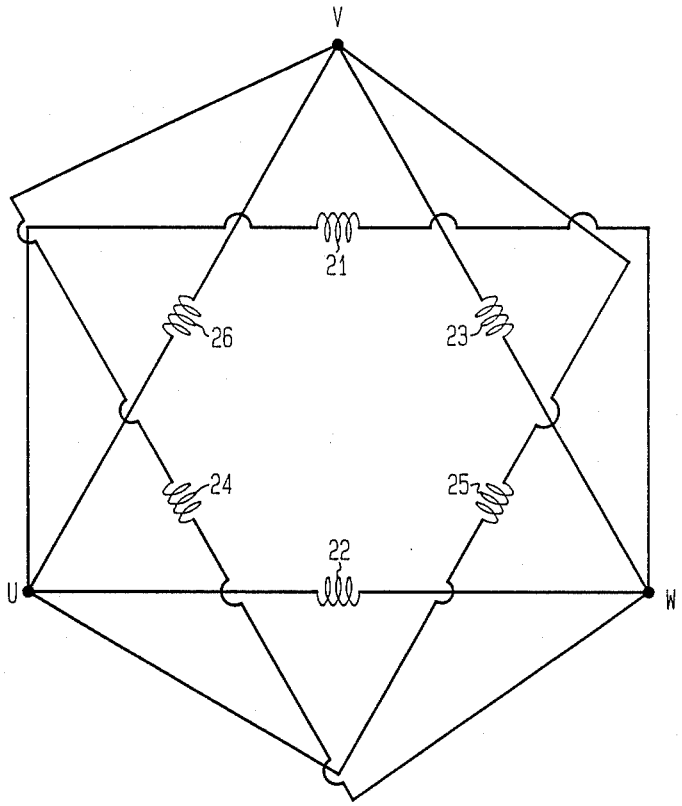
FIG. 4 is a diagram of the electric circuit for the second embodiment.

FIG. 3 shows another embodiment having no movable parts. Here, a lens system 14 is formed by three magnetic lenses. Each lens resembles the lens of the first embodiment, with two opposite horseshoe magnets 15, 16, 17, 18, 19, 20 and a coil 21, 22, 23, 24, 25, 26, wrapped around each magnet. All three lenses are arranged in a X-Y plane perpendicular to the beam axis, consecutive lenses being offset against each other by 120° with respect to axis 4. The two coils of each lens are connected in parallel and jointly connected with one of the three terminals U, V, W of a conventional three-phase current supply, as shown in FIG. 4.

In operation, the lens system creates in the beam area, a field pattern with distinct tangential components perpendicular to beam axis 4. These components diffuse the beam mainly along a fan axis, and this axis moves around the beam axis with the frequency defined by the current supply; after each third of the period the same field pattern, rotated by 120° around the beam axis, is built-up.

If the magnetic poles are properly formed and arranged as a function of the energy, profile and diameter of the electron beam and the frequency of the alternating current, even relatively large circular areas can be homogeneously irradiated, with built-up times less than a second. The diameter of the treatment field may be varied by adjusting the amplitude of the alternating current, and irregular fields can easily be produced by laterally introducing radiation absorbing sheets into the beam.

Having thus described the invention with particular reference to preferred forms thereof, it will be obvious to those skilled in the art to which the invention pertains, after understanding the invention, that various changes and modifications may be therein without departing from the spirit and scope of the invention as defined by the claims appended hereto. For example, the flat beam may be generated by electric rather than magnetic fields or, if the lens system operates with lenses individually activated according to a specific function, activation pulses without overlap for consecutive lenses could be applied. Further, the beam might be spread such that it becomes broader rather than more intense with increasing distance from the beam axis. In some instances, it may be preferable to expand the pencil beam into one instead of two directions along the fan axis or to spread first one half of the beam in one direction and afterwards the other half of the beam into the opposite direction.

We claim:

1. A method of irradiating a circular area with a charged particle beam, comprising the steps of:
   (a) generating a pencil-like charged particle beam having a cross section which is smaller than said circular area;
   (b) directing the charged particle beam along a beam axis;
   (c) spreading the charged particle beam along a fan axis perpendicular to the beam axis; and
   (d) rotating the fan axis around the beam axis with a predetermined frequency.

2. The method according to claim 1, wherein the charged particle beam is generated with a transverse intensity distribution which decreases with increasing distance from the beam axis, and is spread by exerting upon its charged particles a deflecting force which decreases with increasing distance from the beam axis.

3. The method according to claim 2, wherein the deflecting force decreases such that the intensity distribution across the spreaded charged particle beam increases with increasing distance from the beam axis.

4. A method of irradiating a circular area with an electron beam, comprising the steps of:
   (a) generating, within an evacuated chamber, a pencil-like electron beam having a cross section which is smaller than said circular area;
   (b) directing the electron beam through a window of the evacuated chamber along a beam axis;

(c) spreading the charged particle beam along a fan axis perpendicular to the beam axis; and (d) rotating the fan axis around the beam axis with a predetermined frequency.

5. An apparatus for irradiating a circular area with a charged particle beam, comprising:

(a) a source for generating a pencil-like charged particle beam having a cross section which is smaller than said circular area;

(b) means for directing said beam along a beam axis;

(c) a lens system for spreading the emitted charged particle beam along a fan axis perpendicular to the beam axis; and (d) means for rotating the fan axis around the beam axis.

6. The apparatus according to claim 5, wherein the lens system is shaped such that it exerts upon the charged particles a force which decreases with increasing distance from the beam axis.

7. The apparatus according to claim 5, wherein the lens system comprises at least one electrical lens.

8. The apparatus according to claim 5, wherein the lens system comprises at least one magnetic lens.

9. The apparatus according to claim 5, further comprising a beam defining head for receiving the charged particle beam sent along the beam axis, wherein the means for rotating the fan axis includes a frame which carries the lens system, and is attached to the beam defining head so that it is rotatable around the beam axis.

10. The apparatus according to claim 5, wherein the lens system comprises:

(c1) first, second and third lenses, each exerting upon the charged particles a force which tends to spread the charged particle beam along a corresponding first, second and third lens axis, said lens axes extending in a common plane perpendicular to the beam axis and 120° apart from each other; and (c2) means for varying the force of each of said lenses according to a periodic function having the predetermined frequency and being phase-shifted by 120° for consecutive lenses.

11. The apparatus according to claim 10, wherein the lenses are magnetic quadrupole lenses.

12. The apparatus according to claim 11, wherein each magnetic quadrupole lens is composed of two horseshoe magnets, each magnet being wrapped with a coil, wherein further the means for varying the force of each of said magnetic quadrupole lenses include a three-phase current supply with three terminals, and wherein the coils are delta-connected to the terminals, with both coils of each magnetic quadrupole lens connected in parallel.

13. The apparatus according to claim 5, further comprising a vacuum system containing the source for generating the charged particle beam and a window for transmitting the charged particle beam, said window being disposed upstream from the lens system.

* * * * *